US010598050B2

(12) United States Patent
Gormat et al.

(10) Patent No.: US 10,598,050 B2
(45) Date of Patent: Mar. 24, 2020

(54) SCISSOR TYPE COMPRESSION AND EXPANSION MACHINE USED IN A THERMAL ENERGY RECUPERATION SYSTEM

(71) Applicant: Valeo Systemes Thermiques, Le Mesnil Saint Denis (FR)

(72) Inventors: Abdelaziz Gormat, Le Mesnil Saint Denis (FR); Jean-Sylvain Bernard, Le Mesnil Saint Denis (FR); Stéphane Tondelli, Le Mesnil Saint Denis (FR); Bertrand Gessier, Le Mesnil Saint Denis (FR)

(73) Assignee: Valeo Systemes Thermiques, Le Mesnil Saint Denis (FR)

( * ) Notice: Subject to any disclaimer, the term of this patent is extended or adjusted under 35 U.S.C. 154(b) by 53 days.

(21) Appl. No.: 15/551,927

(22) PCT Filed: Feb. 19, 2016

(86) PCT No.: PCT/EP2016/053604
§ 371 (c)(1),
(2) Date: Aug. 18, 2017

(87) PCT Pub. No.: WO2016/131979
PCT Pub. Date: Aug. 25, 2016

(65) Prior Publication Data

US 2018/0030858 A1 Feb. 1, 2018

(30) Foreign Application Priority Data

Feb. 20, 2015 (FR) ..... 15 51498

(51) Int. Cl.
*F01K 23/06* (2006.01)
*F01C 1/063* (2006.01)
(Continued)

(52) U.S. Cl.
CPC ..... *F01K 23/065* (2013.01); *F01C 1/063* (2013.01); *F01C 1/07* (2013.01); *F01C 21/18* (2013.01);
(Continued)

(58) Field of Classification Search
CPC ..... F01K 23/065; F01K 23/14; F01C 1/07; F01C 21/008; F02G 1/02
See application file for complete search history.

(56) References Cited

U.S. PATENT DOCUMENTS 4,753,073 A * 6/1988 Chandler ..... F02G 1/044 60/519
5,211,017 A * 5/1993 Pusic ..... F01C 19/02 60/519
(Continued)

FOREIGN PATENT DOCUMENTS

EP 0 012 329 A1 6/1980
EP 0012329 A1 * 6/1980 ..... F01C 1/07
WO 2012/062591 A2 5/2012

OTHER PUBLICATIONS

EP 0012329 A1 English Translation (Year: 1979).*
(Continued)

*Primary Examiner* — Mark A Laurenzi
*Assistant Examiner* — Shafiq Mian
(74) *Attorney, Agent, or Firm* — Osha Liang LLP

(57) ABSTRACT

A compression and expansion machine is disclosed that includes a body with at least one chamber about an axis of symmetry, and pistons rotating about the axis of symmetry and dividing the chamber into cells rotating with the pistons. The invention also includes a device for coordinating the movement of the pistons and configured so that, during one rotation cycle, each of the cells performs at least one first expansion/contraction cycle corresponding to a stage of compressing a first stream of gas passing through this cell
(Continued)

and at least one second expansion/contraction cycle corresponding to a stage of expanding a second stream of gas passing through this cell.

16 Claims, 2 Drawing Sheets

(51) Int. Cl.

| | |
|---|---|
| ***F01K 25/10*** | (2006.01) |
| ***F01K 7/36*** | (2006.01) |
| ***F01C 21/18*** | (2006.01) |
| ***F01C 1/07*** | (2006.01) |
| ***F01K 23/14*** | (2006.01) |
| ***F02G 1/02*** | (2006.01) |
| *F01C 21/00* | (2006.01) |
| *F01D 17/10* | (2006.01) |

(52) U.S. Cl.
CPC ..... *F01K 7/36* (2013.01); *F01K 23/14* (2013.01); *F01K 25/10* (2013.01); *F02G 1/02* (2013.01); *F01C 21/008* (2013.01); *F01D 17/105* (2013.01)

(56) References Cited

U.S. PATENT DOCUMENTS

| | | | | |
|---|---|---|---|---|
| 5,335,497 | A * | 8/1994 | Macomber | F02G 1/043 60/519 |
| 6,681,738 | B2 * | 1/2004 | Endoh | F01B 13/06 123/227 |
| 9,127,548 | B2 * | 9/2015 | Ishii | F02B 53/00 60/519 |
| 2002/0100452 | A1 * | 8/2002 | Bozdog | F01C 1/07 123/245 |
| 2007/0181101 | A1 * | 8/2007 | Tardif | F01C 1/073 123/45 R |
| 2009/0301436 | A1 * | 12/2009 | Blunt | F01B 13/06 123/44 R |
| 2015/0377025 | A1 * | 12/2015 | Rolus Borgward | F01C 1/123 418/1 |

OTHER PUBLICATIONS

International Search Report issued in PCT/EP2016/053604 dated Apr. 20, 2016 (2 pages).
Written Opinion of the International Searching Authority issued in PCT/EP2016/053604 dated Apr. 20, 2016 (5 pages).

* cited by examiner

SCISSOR TYPE COMPRESSION AND EXPANSION MACHINE USED IN A THERMAL ENERGY RECUPERATION SYSTEM

The present invention applies to the field of the transformation of thermal energy into work. More particularly, it concerns a scissor-type compression and expansion machine intended to be used in particular in a system causing a fluid to work in order to utilize the thermal losses of an engine, for example in the exhaust or any other heat source.

In fact, despite the improvement in efficiency of engines, a high proportion of the energy remains lost in the form of heat. These losses account for the order of 65% in the case of internal combustion engines running on petrol or diesel. The energy is released by combustion into the cooling circuit of the engine or into the exhaust gases which form a heat source relative to the ambient atmosphere.

Several types of system using a working fluid heated by this heat source have been proposed. In all cases, the fluid undergoes a cycle during which it must be pumped or compressed to enter an exchanger before then being able to provide mechanical energy by expansion.

Certain systems for transforming heat energy into mechanical energy use a Rankine cycle. This is a closed cycle in the sense that the fluid is recovered after expansion, cooled and recycled in order to be compressed before returning to the exchanger. Furthermore, the fluid (generally water) is in vapor form on leaving the exchanger with the heat source, then in liquid form after cooling. These characteristics ensure a good intrinsic efficiency of systems using this cycle. However, they have a number of drawbacks, including the need to install a cooling system which is bulky and consumes part of the cooling thermal flow available for the internal combustion engine, thus reducing the global efficiency of the vehicle.

For this reason, other ways have already been explored with systems using an open cycle. In this case, the working fluid is air, which is drawn in at the inlet to the compressor and expelled to atmosphere after expansion.

A first embodiment, described in WO12062591, uses a turbine mounted next to a compressor on the same shaft. The air is compressed in the compressor, heated by the exhaust gases in the exchanger, then expanded in the turbine. The energy recovered by the turbine on the rotation shaft serves firstly to drive the compressor, and the remainder is available for the desired applications. The use of a turbine requires a continuous air flow. To achieve a good efficiency of the turbine, a high flow is required while retaining sufficient pressure at its inlet. Furthermore, the rotation speeds are high (over 100,000 rpm). Turbocompressors adapted to these conditions are generally large, which leads to a turbine-plus-compressor architecture which is bulky and costly. Furthermore, the size of a suitable cooling system would be prohibitive for a small vehicle.

An alternative embodiment is based on the hot-air piston engine and uses a Brayton cycle. Typically, in this case, the system works with two pistons coupled to the same rotation shaft by their crankshaft. During a rotation, air is drawn in from the outside into the first piston which lowers, it is then pushed towards exchanger with the exhaust gases when the first piston rises again, then expands in the second piston which lowers, and is finally expelled towards the exterior when the second piston rises. The piston system accepts rotation speeds which are lower by an order of magnitude than those of the turbomachine in order to achieve high pressures and hence an acceptable efficiency. To this extent, it reduces the integration constraints. However, the pistons with their air intake systems offer reduced passage cross-sections for the working fluid. As a result, the pistons must be large in order to pass the flow necessary to extract the power released by the exhaust gases. Furthermore, the system uses a piston and crankshaft system, and a system dedicated to intake and exhaust of the working fluid, comprising at least one camshaft and valves intended for opening and closing the inlet and outlet orifices of the working fluid in the system for transforming thermal energy into mechanical energy. The result is a complex system which is still bulky or has a limited power.

As a variant embodiment of the alternating piston machine, rotating blade machines are also known for performing compression and expansion cycles. The blade machine in particular gives high compression and flow rates, with low rotation speeds and a smaller size. However, the blade machine remains limited in terms of the compression rate obtained. Furthermore, it comprises drawbacks with regard to friction. In fact a seal must be ensured at the point of contact between the blades and the wall of the working chamber of the gas, while the movement of the blades comprises a radial component because of the oval shape of the chamber around the rotation axis. The support force exerted by the blades against the wall increases the friction. This drawback is aggravated by the dry nature of the friction, which avoids polluting the air passing through the machine in an open circuit with lubricant.

The object of the invention is to propose a means for performing the functions of compression and expansion of the working fluid, which provides high performance in terms of compression and flow rates while improving the compactness and the losses due to friction in comparison with a blade machine.

PRESENTATION OF THE INVENTION

The invention concerns a compression and expansion machine comprising a body with at least one chamber about an axis of symmetry, and pistons rotating about the axis of symmetry and dividing the chamber into cells rotating with the pistons, said machine furthermore comprising a device for coordinating the movement of said pistons, configured such that during one rotation cycle, each cell performs at least one first expansion/contraction cycle corresponding to a stage of compressing a first stream of gas passing through this cell, and at least one second expansion/contraction cycle corresponding to a stage of expanding a second stream of gas passing through this cell.

The characteristics of the compression and expansion machine in terms of flow and pressure favorably influence the efficiency of an energy recuperation system in several ways. At the level of the thermodynamic cycle, this machine—which works on the same principle of compression or expansion of a gas in a closed cell as a piston with reciprocating motion—allows high useful pressures to be achieved with a lower rotation speed than turbocompressors, and hence a gain in compactness and weight. Also, the large passage cross-sections allowed by the rotational motion of the cells in the chamber allows a higher flow and reduces the load losses in the machine in comparison with pistons of comparable size. Furthermore, in contrast to the blades of a blade machine, the movement of the pistons has no radial component. It is therefore easier to design their interface with the wall of the chamber to ensure the seal between the cells and to minimize friction.

Preferably, the coordination device is configured such that each cell performs the same number of first expansion/contraction cycles corresponding to a stage of gas expansion as second expansion/contraction cycles corresponding to a stage of gas compression.

This corresponds to an even number of expansion/contraction cycles performed by the cells. From a mechanical viewpoint, this can be achieved with two pairs of pistons, the pistons of each pair moving together. The pistons of each pair are for example diametrically opposed. Such a configuration may therefore be achieved with a device for coordinating the piston movement with simplified architecture.

Advantageously, the chamber comprises gas inlet and outlet openings for each expansion/contraction cycle of the cells, wherein the passage cross-section of the gas inlet opening is larger than the passage cross-section of the outlet opening on the first cycle(s), and the passage cross-section of the gas inlet opening is smaller than the passage cross-section of the outlet opening on the second cycle(s).

Advantageously, the machine has at least four openings to allow the transfer of fluid. At least two openings are provided on the machine and communicate with the ambient air, and at least two further openings are also provided on the machine and communicate with the exchanger. The working fluid pressures are different, such that the opening cross-sections are adapted accordingly. The exchange zone with ambient air is known as the low-pressure zone, and that with the exchanger is the high-pressure zone.

Furthermore, the machine comprises two openings per zone (HP and LP) since the flow direction is different. For each zone, one opening is intended for circulation of the working fluid from the interior of the machine towards the exterior, the other opening allowing its circulation from the exterior of the machine to the interior.

Advantageously, the machine comprises two pairs of pistons.

According to different variants of the invention which may be taken together or separately:

- the distance between two openings of a same zone, for example the HP zone or the LP zone, is smaller than the distance between two openings of two separate HP and LP zones;
- the inlet opening of the first cycle is close to the outlet opening of the second cycle;
- the outlet opening of the first cycle is close to the inlet opening of the second cycle;
- the inlet opening of the first cycle and the outlet opening of the second cycle are diametrically opposed relative to the inlet opening of the second cycle and the outlet opening of the first cycle;
- the inlet opening of the first cycle and the outlet opening of the second cycle have a larger cross-section than the outlet opening of the first cycle and the inlet opening of the second cycle.

Also preferably, each cell, during one rotation cycle, performs one and only one first cycle, and one and only one second cycle, an intake stage of the first cycle on one cell having a time period common to an exhaust stage of the second cycle on the cell which follows it in the rotation movement. This allows an increase in the gas flow passing through the machine.

The intake of the first cycle on one cell may also be offset in time relative to the exhaust of the second cycle on the cell which follows it in the rotation movement. This allows an increase in the pressure during the stage of heating in the exchanger.

Advantageously, the coordination device comprises means for coordinating the movement of the pistons which are fluidically separated from the chamber. This configuration allows correct lubrication of the mechanics of the coordination means and avoids introducing lubricant into the chamber where the pistons are rotating.

Preferably, sealing means between the pistons and the inner wall of the chamber are designed to separate the cells and allow dry friction on the walls of the chamber. Because only said sealing means are interposed between the rotating piston and the inner wall of the chamber, the fiction area is reduced. Such a reduction is reflected in an increase in the seal tightness, which allows an increase in both pressure and efficiency of the machine. Also, in addition to the dry friction, the air evacuated outside the machine working in open cycle is not loaded with lubricant particles, such that the atmosphere is not polluted.

Advantageously, the cross-section of the chamber on an axial plane is rounded, for example oval, elliptical or circular. This allows the design of one-piece sealing means which are more resistant to wear.

The invention also concerns a device for recovering energy from a hot thermal source, said device comprising a heat exchanger between a working fluid and the heat source, and a compression and expansion machine as described above, said device being configured such that at a given instant, the working fluid returns to the exchanger after having undergone the compression stage in a first cycle of the machine, and leaves the exchanger in order to undergo the expansion stage in a second cycle of the machine.

Said device could be configured such that at a given instant, the working fluid returns to one of the cells of the machine during an intake period and leaves from another of the cells of the machine after having undergone a compression stage.

Alternatively or additionally, said device is configured such that at a given instant, the working fluid returns to the exchanger after having undergone the compression stage in one of the machine cells, and leaves the exchanger to undergo the expansion stage in the same cell or in another of the machine's cells.

Also alternatively or additionally, said device is configured such that at a given instant, the working fluid returns to the exchanger having undergone the compression stage in one of the machine cells, and leaves the compression and expansion machine after having undergone an expansion stage.

Preferably, in this device, the entire stream of working fluid passing through one of the first cycles is processed by only one of the second cycles. This corresponds in particular to a four-piston machine, which allows a gain in compactness and also the losses due to friction in the machine, and the complexity of implementation.

Advantageously, the energy recuperation device uses a cycle open to ambient atmosphere. The fluid used is therefore air. In the case of an application to a motor vehicle for example, the open cycle has the advantage over a closed cycle that no cooling exchanger need be fitted in the front part, which would consume some of the calories for cooling the internal combustion engine. Furthermore, the cooling circuit requires extraction of some of the energy for operation. Thus, although the efficiency of an open cycle is intrinsically lower than that of a closed cycle, the global efficiency and integration in the vehicle are better.

In a particular application, the exhaust gases of an internal combustion engine form the heat source. This is advantageously the case for installation in a motor vehicle.

In this device, the working fluid preferably circulates in counter-current to the exhaust gases in the heat exchanger.

DESCRIPTION OF THE DRAWINGS AND OF THE INVENTION

The present invention will be better understood and further details, characteristics and advantages of the present invention will appear more clearly from reading the description which follows, with reference to the attached drawings on which:

The invention concerns a scissor-type rotating piston machine designed to be used in an energy recuperation system by causing a fluid to work in a cycle comprising stages of intake, compression, heating and expansion, and exhaust, as has been explained above. The exemplary embodiment of the invention is presented in the context of integration in a motor vehicle powered by an internal combustion engine, for recovery of the energy dissipated by the exhaust gases. However, the applicant does not intend to limit the scope of his invention to this context, since it is easy to transpose the type of heat source or energy recovered to other installations.

Figure 1:
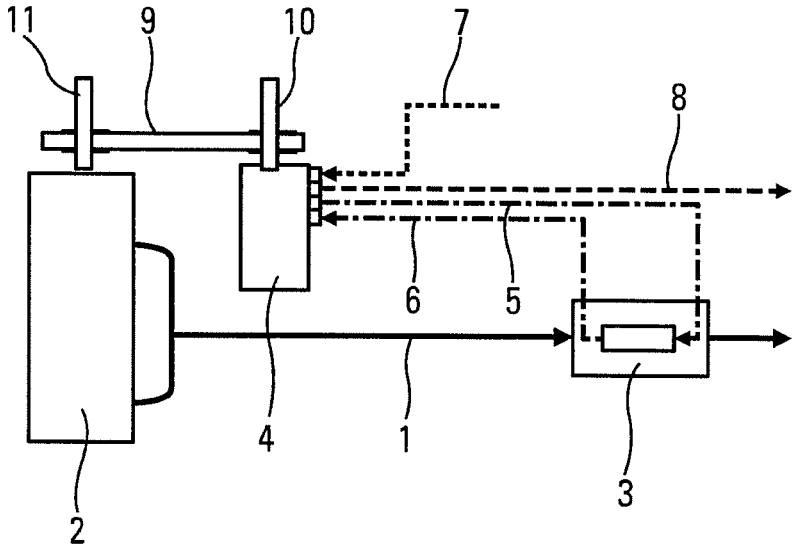
FIG. 1 shows diagrammatically the installation of a system according to the invention for recovering energy from the exhaust gases of an internal combustion engine.

The exemplary system shown diagrammatically in FIG. 1 uses air as a working fluid in an open cycle. The air is drawn in under ambient atmospheric conditions before being compressed and then expelled to atmosphere after expansion. As has been explained above, this choice is advantageous in terms of integration in the vehicle but does not exclude the choice of a closed cycle with cooling of the working fluid in other installations.

The exemplary system described here comprises:

- a heat source formed by the exhaust gases circulating in the exhaust pipe 1 and originating from the internal combustion engine 2;
- a heat exchanger 3 between these exhaust gases and the air, which is placed on the exhaust pipe 1;
- a compression and expansion machine 4, performing firstly compression of the air entering the exchanger 3 and secondly expansion of the hot air leaving the exchanger 3;
- conduits 5 for circulating the compressed air from the machine 4 towards exchanger 3, and conduits 6 for returning the air heated in the exchanger 3 to the machine 4;
- conduits 7 for drawing in ambient air to the machine 4, and conduits 8 for expelling the worked air to atmosphere;
- a drive and energy recuperation system 9.

In the embodiment shown on the figure, the drive and energy recuperation system 9 is a means of mechanical transmission between the shaft 10 of the compression and expansion machine 4, and the shaft 11 of the engine driving the vehicle, and is intended to recover the excess torque supplied by the shaft 10. In a variant, the system 9 may be an electric motor connected to the shaft 10 of the machine 4 and intended to operate as a generator under the action of the shaft 10.

Figure 2:
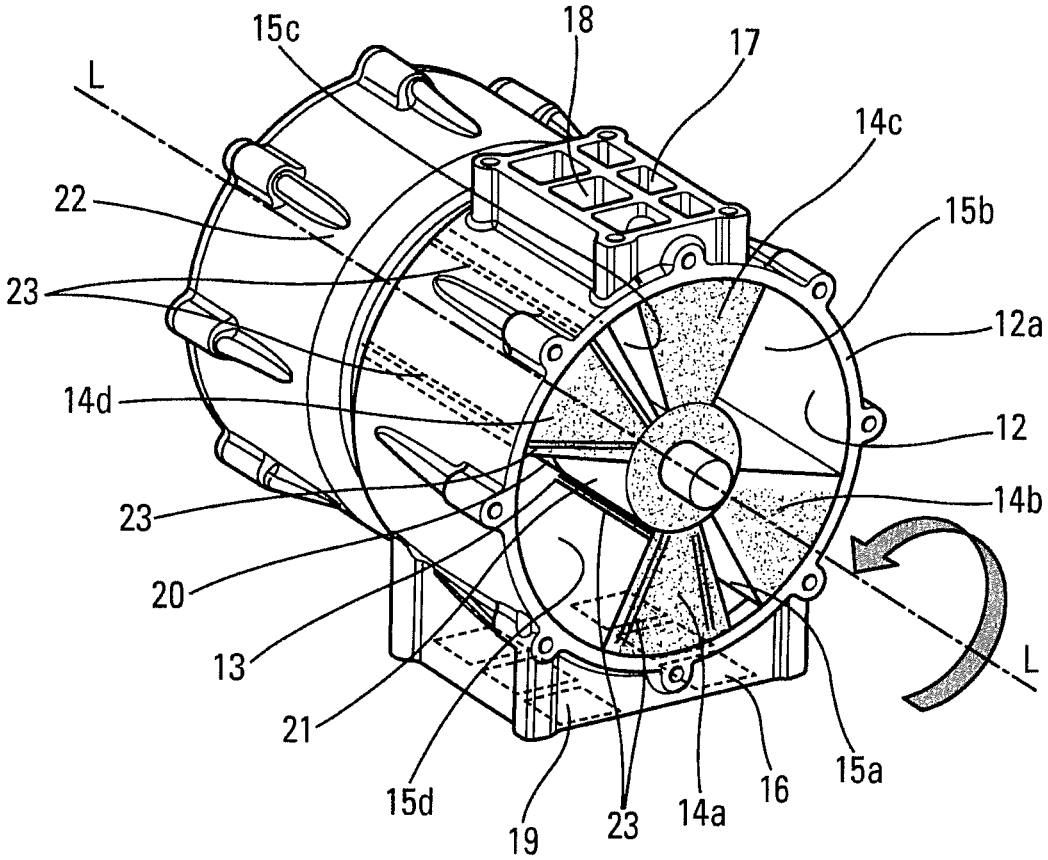
FIG. 2 shows diagrammatically a perspective view of a first embodiment of a scissor-type piston machine according to the invention.

According to a first embodiment, with reference to FIG. 2, the scissor-type piston machine comprises a hollow body 12*a* forming a cylindrical chamber 12 of circular cross-section around an axis L-L.

The hollow body comprises four slots forming openings 16, 17, 18, 19 in the chamber 12. On the example, these openings are made on the outer wall of the chamber 12. They may be segmented, here into three orifices, over the length of the chamber 12 along the rotation axis, as shown on FIG. 2. They have an angular extension defined around the rotation axis and are arranged in pairs.

On the example, with reference to FIG. 2 and turning counter-clockwise:

- a first opening 16 is situated at the bottom and is intended to be connected to the conduit 7 drawing in ambient air,
- a second opening 17 is situated at the top, substantially vertically above the first opening 18, and is intended to be connected to the conduit 5 sending the air to the exchanger 3,
- a third opening 18 is also situated at the top, close to the second opening 17, and is intended to be connected to the conduit 6 carrying the air leaving the exchanger 3,
- a fourth opening 19 is situated at the bottom, substantially vertically below the third opening 18 and close to the first opening 16, and is intended to be connected to the conduit 8 expelling the air to atmosphere.

Four pistons 14*a*, 14*b*, 14*c*, 14*d* rotating about axis L-L are installed inside the chamber 12. They are configured to each occupy a portion of angular sector, of a given angle, between the outer cylindrical wall of the chamber 12 and an inner cylindrical surface 13 of circular cross-section transversely to the axis of rotation L-L.

These pistons are grouped into two diametrically opposed pairs of pistons. The pistons of each pair are integral. However, the two piston pairs may rotate around the axis differently, moving away or drawing closer. In this way, the four pistons in pairs define, between the outer wall of the chamber 12 and the inner surface 13, four cells 15*a*, 15*b*, 15*c*, 15*d*, the volume of which may increase or diminish.

The movement of the two pairs of pistons is coordinated such that each of the four cells 15*a*, 15*b*, 15*c*, 15*d* undergoes two expansion and contraction cycles when passing in front of the four openings 16, 17, 18, 19 of the chamber 12.

To achieve this result, a first pair of pistons 14*a*, 14*c* is connected to a first shaft 20 which forms a portion of the inner cylindrical surface 13 over approximately half the length along the rotation axis. This first shaft 20 for example is hollow and allows the passage of the second shaft 21, which forms the cylindrical surface 13 over the second half of the length along the rotation axis, and to which the second pair of pistons 14*b*, 14*d* is fixed. In this way, the two pairs of pistons 14*a*-14*c*, 14*b*-14*d* can be driven separately in rotation by the two shafts 20, 21.

The two shafts pass through a transverse face of the wall of the chamber 12 and, outside this chamber 12, are coupled together and/or to the shaft 10 leaving the scissor-type machine 4 by a device 22 coordinating their movements, which allows them to perform cycles of expansion and contraction of the cells 15*a*, 15*b*, 15*c*, 15*d* while the shaft 10 of the machine 4 performs a regular rotation movement. This device for coordinating the movement of the pistons may be implemented for example by an epicyclic gear mechanism.

The point at which the shafts 20, 21 pass through the chamber 12 is equipped with a sealing means which ensures that the lubricant used for the mechanisms of the coordination device 22 of the pistons 14*a*, 14*b*, 14*c*, 14*d* does not return to the chamber 12. This therefore prevents polluting with lubricant the air which passes into the cells and is then expelled into the atmosphere.

Since each piston has a shape which closely conforms to that of the inner wall of the chamber 12 and the inner cylindrical surface 13 created by the two shafts 20, 21, the four cells are theoretically separated such that the air they contain is either compressed or expanded depending on the variation in their volume when they are not passing in front of an opening 16, 17, 18, 19.

However, the contact points between a piston 14*a*, 14*b*, 14*c*, 14*d* and the walls of the chamber 12 and the portion of the inner cylindrical surface 13 created by the shaft 20, 21 to which it is not connected, are movable. The tightness of a cell 15*a*, 15*b*, 15*c*, 15*d* between the pistons 14*a*, 14*b*, 14*c*, 14*d* which delimit it is advantageously ensured by sealing segments 23 placed on the surface of said piston and rubbing against the walls on which it slides.

It should be noted that the friction losses in the scissor-type machine, due to the movement of the pistons 14*a*, 14*b*, 14*c*, 14*d* in the chamber, are therefore linked solely to the sliding of these segments 23 on the walls. This technology therefore induces a minimum of losses, in particular because the movements of the pistons remain tangential to the walls against which a seal must be provided.

On the example of FIG. 2, the internal volume of the chamber 12 in which the pistons 14*a*, 14*b*, 14*c*, 14*d* move has the shape of a torus of rectangular section. A sealing segment 23 is therefore formed from four rectilinear portions, two following the parts of the edge of the piston sliding against the flat faces axially delimiting the chamber 12, one following the part sliding against the cylindrical face of the chamber 12, and one following the part sliding on the shaft 20, 21 which does not rotate in phase with the piston.

Figure 3:
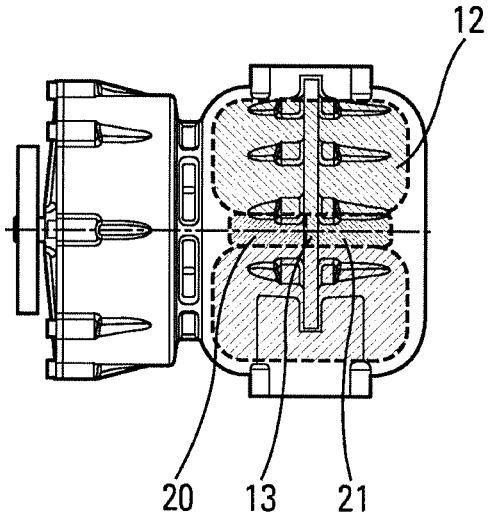
FIG. 3 shows diagrammatically a side view of a second embodiment of the scissor-type piston machine according to the invention.

According to a second embodiment with reference to FIG. 3, the hollow body 12*a* is modified such that the walls transverse to axis L-L of the chamber 12 come to rejoin, with continuity of tangent, the peripheral cylindrical wall of this chamber. Furthermore, these transverse walls connect tangentially to the inner cylindrical surface 13 formed by the outer wall of the two shafts 20, 21 to which the pistons are attached. The volume in which the pistons move therefore assumes the form of a torus of ovoid cross-section, with a rectilinear portion of the cross-section at the level of the shafts 20, 21 and the outer part.

This embodiment allows the production of one-piece sealing segments which have no joint between two rectilinear portions.

Figure 4:
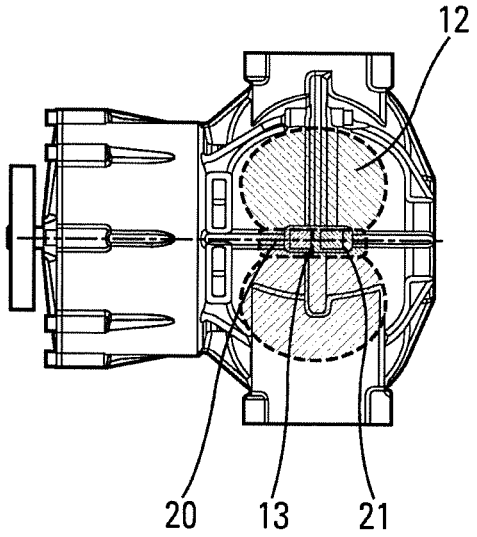
FIG. 4 shows diagrammatically a side view of a third embodiment of the scissor-type piston machine according to the invention.

According to a third embodiment with reference to FIG. 4, the hollow body 12*a* and the outer walls of the two shafts 20, 21 are designed such that the volume in which the pistons move assumes the form of a torus of circular section. This form allows the use of sealing segments 23 of circular form. The inner surface 13 formed by the walls of the shafts 20, 21 driving the pistons is no longer cylindrical but has a revolution form created by the corresponding circle portion. This form allows a better strength of the segments and ensures a better seal between the pistons and the walls of the chamber 12.

Figure 5:
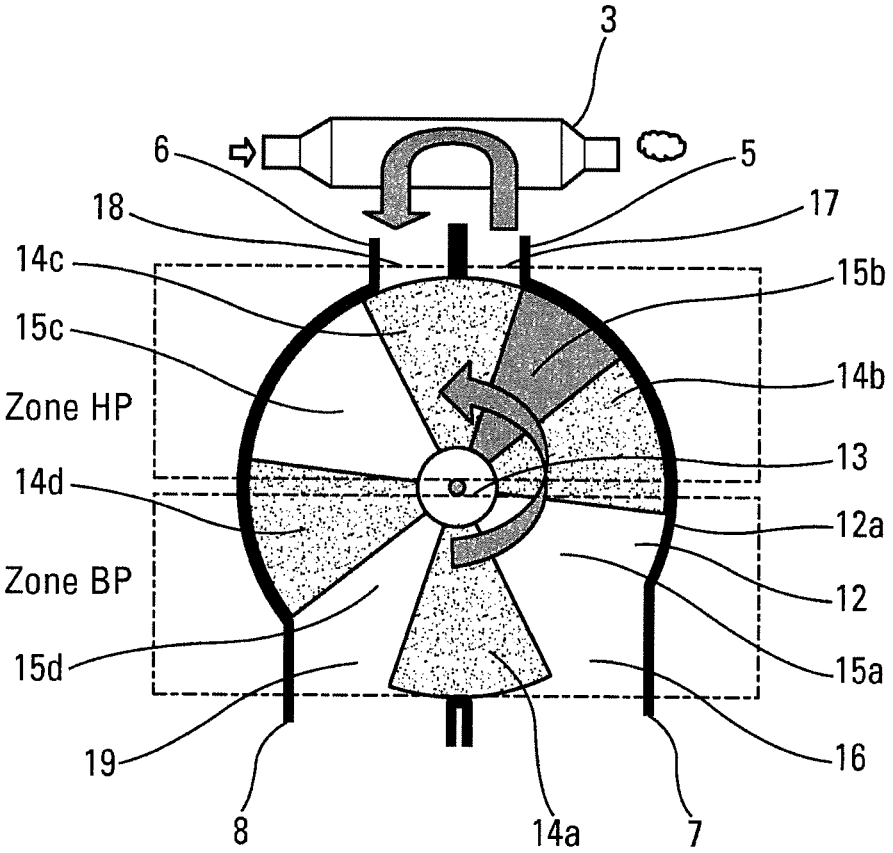
FIG. 5 shows diagrammatically the function of a scissor-type piston machine according to the invention in an energy recuperation system.

With reference to FIG. 5, with the pistons 14*a*, 14*b*, 14*c*, 14*d* turning counterclockwise, the scissor-type machine 4 causes the air to circulate discontinuously in the system by aspiration/pressure of pulses of gas corresponding to the passage of the cells 15*a*, 15*b*, 15*c*, 15*d* in front of the openings 16, 17, 18, 19 of the chamber 12.

The pistons 14*a*, 14*b*, 14*c*, 14*d* are identical in size, and the two pairs of pistons 14*a*-14*c*, 14*b*-14*d* follow the same movement but out of phase. The four cells 15*a*, 15*b*, 15*c*, 15*d* therefore perform an identical cycle during a complete rotation, which is described below to show how the machine causes the air to circulate.

One pair of pistons 14*a*-14*c* slows down when approaching the vertical, on FIG. 5 one of the pistons 14*a* being between the opening 16 for intake of ambient air and the opening 19 for expulsion to atmosphere. During this time, the other pair of pistons 14*b*-14*d* accelerates, such that the piston 14*b* which has just passed before the intake opening 16 catches up with the piston 14*c* of the first pair, placed at the top, and the piston 14*d* which has just passed before the opening dedicated to gas returning from the exchanger 3 catches up with the piston 14*a* of the first pair, situated at the bottom.

In this way, the cell 15*a* situated between the piston 14*a* which has nearly stopped at the bottom, and the piston 14*b* which is moving away from there, draws in ambient air through the opening 16. The piston 14*a* situated at the bottom, by being interposed between the bottom openings 16, 19, prevents this cell 15*a* from drawing in external air through the return opening 19. During this time, the cell 15*b* situated between the piston 14*c* which has almost stopped at the top and the piston 14*b* which is approaching this point, compresses the air it contains and which has just been drawn in from the ambient air. At a given moment, although its movement is slow, piston 14*c* advances and clears the opening 17 for communication with the exchanger 3, and the air compressed in the cell 15*b* can escape towards the exchanger.

In this way, with reference to FIG. 5, the machine therefore draws in ambient air at low pressure through the bottom right-hand opening 16, and expels the air at high pressure through the top right-hand opening 17.

Thanks to a symmetrical mechanism, and simultaneously, the machine draws in high-pressure air from the exchanger 3 through the top left-hand opening 18, and returns the expanded air at low pressure to atmosphere via the bottom left-hand opening 19.

In an offset mechanism, the instants of intake of high-pressure air from the exchanger 3 through the top left-hand opening 18, and of return of the expanded low-pressure air to atmosphere through the bottom left-hand opening 19, are offset in time. This allows an improvement in the machine efficiency. In fact the cell 15*c* situated between the piston 14*c* which has almost stopped at the top and the piston 14*d* which is moving away from there, is the origin of an expansion of the air it contains. This air came from the opening 18 connected to the outlet of the exchanger 3 when the top piston 14*c* was not blocking the air inlet opening 18.

In a similar fashion to the situation between the two openings 19, 18 at the bottom, the movement of the piston 14*c* and its angular size are determined such that it is interposed between the outlet opening 17 for the high-pressure air and the inlet opening 18 of the heated high-pressure air. In this way, there is no mixing between the air passing through the machine 4 on the right towards the exchanger 3, and the air passing through the machine 4 on the left and leaving the exchanger.

The return circuit terminates in the cell 15*d* situated between the piston 14*a* which has almost stopped at the bottom and the piston 14*d* which is catching up with it. By contracting, the cell 15 expels the expanded air to atmosphere through the opening 19.

It could also be noted that this operating mode separates the scissor-type piston machine 4—approximately—into a high-pressure zone in the upper half and a low-pressure zone in the lower half with reference to FIG. 5.

The openings 16, 19 of the low-pressure zone are advantageously adapted to allow the same flow to pass as the corresponding openings 17, 18 which are situated in the air circuit but in the high-pressure zone of greater volumic mass. The openings 16, 19 of the low-pressure zone are therefore advantageously larger than those of the high-pressure zone, since the mass volume of air passing through them is greater. This allows a large passage flow through the scissor-type machine 4 and avoids creating parasitic load losses at the low-pressure openings.

On the exemplary embodiment presented with reference to FIG. 5, a difference can be seen between the openings 16, 19 of the low-pressure zone and the openings 17, 18 of the high-pressure zone.

The large size of the openings 16, 19 of the low-pressure zone relative to the angular extension of the piston 14*a* placed between them, allows the air intake in the cell 15*a* on the right and the air expulsion in the cell 15*d* on the left to take place simultaneously over a time period in the machine's operating cycle. This phenomenon may be useful for promoting the circulation of air and increasing the flow passing through the machine.

In contrast, on the example, the relative size of the piston 14*c* passing at the top and the openings 17, 18 of the high-pressure zone means that, at a given moment, the piston 14*c* blocks all communication between one of these openings 17, 18 and any of the cells 15*b*, 15*c* passing in front of them. In this example, the phases of air intake from the exchanger 3 into a first cell 15*c* through the intake opening 18, and expulsion through the outlet opening 17 of the air compressed in the cell 15*b* which follows the first cell 15*c* in the rotation movement, take place at two separate successive moments. Operating variants may be considered, depending on the relative size of the openings and pistons and of the position of the openings. However, the pistons all have the same angular span.

Other embodiments are also possible by varying the number of pistons and openings in the chamber 12. However, the number of pistons and openings shall a priori be a multiple of four, to ensure that each circuit drawing the air in and sending it to the exchanger corresponds to a circuit receiving the air from the exchanger and expelling it to atmosphere.

The function of the energy recuperation system on start-up could begin with the scissor-type machine 4 being driven by the drive and mechanical energy recuperation system 9.

When the system has begun operation, the global cycle of five periods may be described by following one of the air pulses passing through the scissor-type machine 4.

In a first period, a cell 15*a* passing in front of the opening 16 at the bottom right draws in this air pulse taken from atmosphere by means of the conduit 7, and causes an increase in its volume at constant pressure.

In a second period, the cell 15*b* contracts in volume while rotating, compressing this air pulse and pushing it into the conduit 5 through the opening 17. The compression may take place up to an optimal operating pressure range of between 3 and 12 bar in the automotive application presented.

In a third period, this air pulse is transferred to the air/exhaust gas heat exchanger 3 via the conduit 5. The temperature rises together with the pressure due to the thermal energy supplied to the air.

In the embodiment presented, the air passes through the exchanger 3 in the opposite direction to the exhaust gases inside specific conduits. This exchanger arrangement, adapted to the configuration of the exhaust pipe 1, optimizes the heat exchange for a given contact distance between the flow of exhaust gases and the stream of working air. Furthermore, the high pressure level of the air in the circuit allows a compact design of exchanger 3.

In a fourth period, a heated and compressed air pulse is returned to the scissor-type machine 4 via the third conduit 6. The air enters the machine 4 through the top opening 18 and expands in a cell 15*c*, which increases in volume as it rotates.

With reference again to FIG. 5, the expansion of the hot compressed air causes the first pair of pistons 14*a*-14*d* to rotate around axis L-L and generates a mechanical energy. The piston coordination device 22 uses part of this energy to cause a second pair of pistons 14*b*-14*d* to also move, and causes the scissor-type machine 4 to undergo the first two periods, compressing the pulses of air arriving in the exchanger. The piston coordination device 22 restores the remaining energy to the rotating shaft 10 leaving the scissor-type machine 4. The system functions in recuperation mode as soon as the energy supplied by expansion is greater than the energy from compression and the losses of the device.

In the fifth period, by continuing its rotation and contracting, the cell 15*d* expels the air pulse towards the conduit 8 for expulsion to atmosphere through the bottom opening 19. At the end of the expansion, the pressure and temperature of the air fall. The air is evacuated towards the outside at a temperature of around 100° C.

The stage of compressing the air in the machine 4 corresponds to the first two cycle periods of intake and compression, while the expansion stage corresponds to the fourth and fifth periods of expansion and exhaust.

A scissor-type machine 4 may achieve pressures of the order of 3-20 bar with rotation speeds of less than 10,000 rpm.

With regard to the flow rate, in the example there are four cells 15*a*, 15*b*, 15*c*, 15*d* which continuously pass in front of the openings 14*a*, 14*b*, 14*c*, 14*d* of the chamber 12. Therefore, the first period of a cycle begins immediately following the first period of the preceding cycle. It is not therefore necessary to allow a time to elapse, as in a four-stroke reciprocating piston machine. Furthermore, the four periods take place in the same chamber 12, whereas in comparison, in a reciprocating machine, one piston would be used for the intake/compression stage of the air coming from atmosphere, and one piston for the expansion/exhaust stage of the heated air. The machine is therefore much more compact than a reciprocating movement piston machine for a same flow rate.

Furthermore, because of the design of air circulation in the machine, the openings may be optimized. Because these openings concern different zones of the chamber, and also because the rotating means have a continuous movement when passing in front of them, the geometry of the machine allows the passage cross-sections to be optimized. These passage cross-sections allow a reduction in load losses. In comparison with a machine using pistons with reciprocating movement, such a machine allows a gain of several factors in the flow rate with lower load losses, which improves the efficiency of the system.

Also, in comparison with a blade machine which is another type of rotating volumetric machine, the configuration allows further advantages, such as better monitoring of the rate of compression and expansion of the cells, and hence equivalent performance to be obtained with a smaller volume.

In a variant embodiment (not shown), intake air already compressed passes into the conduit 7 to be drawn into a cell 15*a* during the first period of the cycle, which allows a reduction in the size of the machine for the same performance. For example, the compressed air may be taken from a turbocompressor which uses the exhaust gases as a source for driving the compressor in rotation.

In another variant embodiment (not shown), the intake air—either ambient air or compressed air—is first cooled before entering the machine via an intake air cooler for example, which allows a reduction in the temperature of the working fluid entering the exchanger, and hence an increase in efficiency of the energy recuperation device.

In fact, to operate optimally, the temperature of the working fluid on entry to the exchanger must be lower than the temperature of the heat source circulating in the exchanger.

In the context of an application to a vehicle powered by an internal combustion engine, the system will be furthermore advantageously adapted to the variations in engine speed or atmospheric conditions, for example by introducing bypass-type systems on the air circuit and on the exhaust pipe for the engine gases upstream of the heat exchanger, in order to adapt the flow rates to the energy which may be recovered. Also, in a variant, with a view to optimizing efficiency, additional cooling of the rotating volumetric machine by a water or air circuit or by fins may prevent excessive heating thereof from friction and from the working fluid coming from the exchanger.

The invention claimed is:

1. A compression and expansion machine comprising:

a body with at least one chamber about an axis of symmetry;

pistons rotating about the axis of symmetry and dividing the chamber into cells rotating with the pistons; and a coordination device for coordinating the movement of the pistons, the coordination device configured so that, during one rotation cycle, each of the cells performs at least one first expansion/contraction cycle corresponding to a stage of compressing a first stream of gas passing through said each of the cells, and at least one second expansion/contraction cycle corresponding to a stage of expanding a second stream of gas passing through said each of the cells, wherein the body further comprises a gas inlet opening and a gas outlet opening for each expansion/contraction cycle of said each of the cells, and wherein a passage cross-section of the gas inlet opening of the at least one first expansion/contraction cycle is larger than a passage cross-section of the outlet opening of the at least one first expansion/contraction cycle, and a passage cross-section of the gas inlet opening of the at least one second expansion/contraction cycle is smaller than a passage cross-section of the outlet opening of the at least one second expansion/contraction cycle.

2. The compression and expansion machine as claimed in claim 1, wherein the coordination device is configured such that said each of the cells performs a same number of the at least one first expansion/contraction cycle corresponding to a stage of gas expansion as the at least one second expansion/contraction cycle corresponding to a stage of gas compression.

3. The compression and expansion machine as claimed in claim 1, wherein the gas inlet opening of the at least one first expansion/contraction cycle is close to the gas outlet opening of the at least one second expansion/contraction cycle.

4. The compression and expansion machine as claimed in claim 1, wherein the gas outlet opening of the at least one first expansion/contraction cycle is close to the gas inlet opening of the at least one second expansion/contraction cycle.

5. The compression and expansion machine as claimed in claim 1, wherein the gas inlet opening of the at least one first expansion/contraction cycle and the gas outlet opening of the at least one second expansion/contraction cycle are diametrically opposed relative to the gas inlet opening of the at least one second expansion/contraction cycle and the gas outlet opening of the at least one first expansion/contraction cycle respectively.

6. The compression and expansion machine as claimed in claim 1, wherein the passage cross-section of the gas inlet opening of the at least one first expansion/contraction cycle and the passage cross-section of the gas outlet opening of the at least one second expansion/contraction cycle is larger than the passage cross-section of the gas outlet opening of the at least one first expansion/contraction cycle and the passage cross-section of the gas inlet opening of the at least one second expansion/contraction cycle.

7. The compression and expansion machine as claimed in claim 1, comprising two pairs of pistons, wherein each of the cells, during the one rotation cycle, performs only one of the at least first expansion/contraction cycle, and only one of the at least second expansion/contraction cycle, an intake stage of the at least one first expansion/contraction cycle on one of the cells having a time period common to an exhaust stage of the at least one second expansion/contraction cycle on the other cell which follows the one of the cells in the rotation cycle.

8. The compression and expansion machine as claimed in claim 7, wherein the intake stage of the at least one first expansion/contraction cycle on one of the cells is offset in time relative to the exhaust stage of the at least one second expansion/contraction cycle on the other cell which follows the one of the cells in the rotation cycle.

9. The compression and expansion machine as claimed in claim 1, wherein the coordination device comprises means for coordinating the movement of the pistons are fluidically separated from the chamber.

10. The compression and expansion machine as claimed in claim 1, further comprising sealing means between the pistons and an inner wall of the chamber to separate said each of the cells and allow dry friction on the inner wall of the chamber.

11. The compression and expansion machine as claimed in claim 1, wherein a cross-section of the chamber on an axial plane is rounded.

12. A device for recovering energy from a hot thermal source, said device comprising:

a heat exchanger between a working fluid and the hot thermal source; and a compression and expansion machine comprising:

a body with at least one chamber about an axis of symmetry;

pistons rotating about the axis of symmetry and dividing the chamber into cells rotating with the pistons; and a coordination device for coordinating the movement of the pistons, the coordination device configured so that, during one rotation cycle, each of the cells performs at least one first expansion/contraction cycle corresponding to a stage of compressing a first stream of gas passing through said each of the cells, and at least one second expansion/contraction cycle corresponding to a stage of expanding a second stream of gas passing through said each of the cells, wherein the body further comprises a gas inlet opening and a gas outlet opening for each expansion/contraction cycle of said each of the cells, and wherein a passage cross-section of the gas inlet opening of the at least one first expansion/contraction cycle is larger than a passage cross-section of the outlet opening of the at least one first expansion/contraction cycle, and a passage cross-section of the gas inlet opening of the at least one second expansion/contraction cycle is smaller than a passage cross-section of the outlet opening of the at least one second expansion/contraction cycle wherein, at a given instant, the working fluid of the compression and expansion machine returns to the heat exchanger after having undergone the stage of compressing in the at least one first expansion/contraction cycle of the compression and expansion machine and leaves the heat exchanger in order to undergo the stage of expanding in the at least one second expansion/contraction cycle of the compression and expansion machine.

13. The device for recovering energy from a hot thermal source as claimed in claim 12, wherein an entire stream of the working fluid passing through one of the at least one first expansion/contraction cycle is processed by only one of the at least one second expansion/contraction cycle of the compression and expansion machine.

14. The device for recovering energy from a hot thermal source as claimed in claim 12, wherein one expansion/contraction cycle is open to ambient atmosphere.

15. The device for recovering energy from a hot thermal source as claimed in claim 12, wherein exhaust gases of an internal combustion engine form the hot thermal source.

16. A compression and expansion machine comprising:

a body with at least one chamber about an axis of symmetry;

two pairs of pistons rotating about the axis of symmetry and dividing the chamber into cells rotating with the pistons; and a coordination device for coordinating the movement of the pistons, the coordination device configured so that, during one rotation cycle, each of the cells performs at least one first expansion/contraction cycle corresponding to a stage of compressing a first stream of gas passing through said each of the cells, and at least one second expansion/contraction cycle corresponding to a stage of expanding a second stream of gas passing through said each of the cells, wherein each of the cells, during the one rotation cycle, performs only one of the at least first expansion/contraction cycle, and only one of the at least second expansion/contraction cycle, an intake stage of the at least one first expansion/contraction cycle on one of the cells having a time period common to an exhaust stage of the at least one second expansion/contraction cycle on the other cell which follows the one of the cells in the rotation cycle.

* * * * *